United States Patent [19]

Hull et al.

[11] Patent Number: 4,882,787

[45] Date of Patent: Nov. 28, 1989

[54] GOLF GLOVE

[76] Inventors: Harold L. Hull, 401 Canyon Way SP 43, Spanks, Nev. 89431; Donald Metcalf, 1280 Landerwood, Reno, Nev. 89511

[21] Appl. No.: 239,671

[22] Filed: Sep. 2, 1988

[51] Int. Cl.[4] ..... A41D 19/00

[52] U.S. Cl. ..... 2/161 A; 2/163

[58] Field of Search ..... 2/161 A, 161 R, 163, 2/159

[56] References Cited

U.S. PATENT DOCUMENTS

| | | | |
|---|---|---|---|
| 1,915,617 | 6/1933 | Potter | 2/161 A X |
| 2,975,429 | 3/1961 | Newman | 2/159 |
| 3,593,339 | 7/1971 | Main et al. | 2/161 A |
| 4,416,026 | 11/1983 | Smith | 2/161 R |
| 4,453,275 | 6/1984 | Kawada | 2/161 A |
| 4,514,861 | 5/1985 | Kamada | 2/161 A |
| 4,573,220 | 3/1986 | Baker | 2/161 A |
| 4,590,625 | 5/1986 | Keim | 2/161 A |
| 4,658,445 | 4/1987 | Tribble | 2/161 A |
| 4,665,565 | 5/1987 | Odom | 2/161 A |
| 4,752,075 | 6/1988 | Bencriscutto | 273/183 B |

OTHER PUBLICATIONS

Gershman, Maurice, "Self Adhering Nylon Tapes," *Journal of AMA,* vol. 168, No. 7, Oct. 1958.

"*A Round of Golf*" by Tommy Armour, pp. 48 and 53, date unknown.

*Primary Examiner*—Werner H. Schroeder

*Assistant Examiner*—Sara M. Current

[57] ABSTRACT

An improved golf glove in which only the ring finger and the little finger and a portion of the palm is covered leaving the index finger and the middle finger and a portion of the palm uncovered thus providing a compromise between the gloved "feel" and the barehanded "feel," and which allows the golfer to easily put on or take off said gloves for putting or the like and which also is economical to manufacture.

3 Claims, 1 Drawing Sheet

GOLF GLOVE

BACKGROUND OF THE INVENTION

The present invention relates to sport gloves or the like and more specifically to golf gloves.

An experienced or novice golfer must maintain complete control over the golf club before, during and after the swing and the ideal method is to keep the "feel" of the club by golfing barehanded, however, this becomes impractical due to perspiration, playing in humid climates, worn club grips, etc, therefore the usual means available to overcome these problems is the use of thin, tight fitting gloves.

In the past, gloves have been developed with deal with these problems such as Kamada of Japan in Pat. No. #4,514,861, Keim of Arizona in Pat. No. #4,590,625, and Bencrisutto in Pat. No. #4,752,075.

These and other patented gloves basically cover the entire hands of the golfer and do not allow any appreciable contact of the hand with the club.

"Feel", in golf language is virtually impossible to define. It is common knowledge that for a right-handed golfer, the right hand that grips the golf shaft is the power hand and the left hand, which is situated above the right hand on the golf club shaft, is the accuracy hand. There seems to be no end to what definitions determine the feel of the golf club shaft in the golfer's hands. For example, in the Mar. 1978 issue of Golf Magazine, the editors interviewed a dozen professional golfers as to what "feel" was to them. The report, which was reported on Page 118, gave many explanations as to what "feel" was. For example, the relationship between the hands and the brain, wherein the brain takes into account many factors, from the environment to a particular golfer's mental and physical state at the particular time the golf club is grasped.

Four of the golfers stated what we the inventors believe to be correct, namely that "feel" is defined as the golfer's sense of the golf club shaft in his or her hands and how the brain perceives the golf club in the golfer's hands. The sensory feed-back of pressure information from the hands to the brain allows the brain to make the decisions which then inform the golfer's muscles how to move or adjust the hands upon the golf club, until the brain determines that a correct "feel" is obtained. Pressure feed-back works on the deeper, unconscious level of awareness, as opposed to such sensory feed-back as pain and temperature.

In achieving this correct "feel", and in particular, the "feel" of the left hand on the club (for a right-handed golfer), the brain is relying on the specialized nerve sensors buried in the four fingers and the palm of the left hand. These pressure-sensitive nerve receptors are called "Pacinian bodies". The Pacinian bodies are connected to the brain by the ulnar and median nerves, which travel up the arm to the brain.

As the left hand grasps the golf club shaft, unequal pressure is felt by the Pacinian bodies in each of the four fingers and the palm of the hand because of the natural concave shape of the palm of the hand and the location of the fingers which connect to the palm. The palm of the hand, in its natural position, is slightly concave, generally referred to as having a concavity. The concavity deepens as the hand flexes as in grasping the golf club handle. Additionally, the palm of the hand is slightly elevated at the point the fingers connect. Accordingly, then, it is obvious that the fingers at opposite ends of the concavity will feel the greatest pressure on the straight club shaft lying across the palm, namely the index and the little finger, while the Pacinian bodies located on the two middle fingers, as well as the palm area, receive less stimulation. In fact, if the left hand were so situated on the golf club as to make substantially equal pressure feelings in each area of the fingers and in the palm, the hand would be deformed from its normal configuration. Clearly, if the accuracy hand is deformed, even though done unconsciously, in trying to grasp the club when making a swing, control of the swing is going to be greatly hampered, and could quite logically be accepted as the cause of golf being such a difficult game.

It is the belief of the inventor's that the present trend of golfers today to wear very tight gloves, is an attempt, unconscious or otherwise, to enhance "feel" by the very nature of being able to feel the glove on the hand.

Also Tom Armour in his book entitled "How to Play Your Best Golf All the Time," state's; "When the club is at that point where the fingers and the palm meets, the fingers can curl around the grip so the sensitive finger tips can communicate the feeling of a good swing to the rest of the player's nervous system" and he also emphasizes to "keep the last two fingers especially snug.

Obviously then, it is easy to see that "feel" of the golf club in the golfer's hand is very hard to define and just as hard to obtain.

It is the object of correcting this problem of obtaining a proper "feel", to which the subject invention is directed.

SUMMARY OF THE INVENTION

It is an object of the present invention to provide a compromise between the "barehanded" feel and the "glove" feel by covering only the ring finger and the little finger with a glove and leaving the index and middle finger and a substantial part of the palm uncovered for better stimulation and the "barehanded" feel.

It is a further object to provide a glove which is easily removable for putting purposes as the glove does not have to be "peeled" off of the hands or over the "thumb butt" to be removed.

It is another purpose to make a glove which is more universal in size as the body of the hand is not covered.

It is still another purpose to provide a glove which allows the golfer to improve his mechanical swing by being able to "focus" open the grip with better impute from the sensors in the hands.

Still another object is to provide a glove which is economical to manufacture as only half the material is necessary and the "fit" is not as critical.

It is a further object to provide a glove with a closure made of the commercially available material trademarked "Velcro" which allows for easier on and off function and variable tightness.

Another object is to provide a glove that eliminates the cumbersome aspects of achieving control but still prevents slipping of the club.

Yet another object is to provide a glove that has small openings in the fingers of the glove that are used to expose the fingers to the "Pacinian bodies" buried in the fingers.

BRIEF DESCRIPTION OF THE DRAWINGS

FIG. 11 shows the palm side of a golfer's right hand wearing the two fingered glove.

FIG. 111 shows a perspective view of the left hand of a golfer wearing the two fingered glove.

DETAILED DESCRIPTION OF THE DRAWINGS

Figure 1:
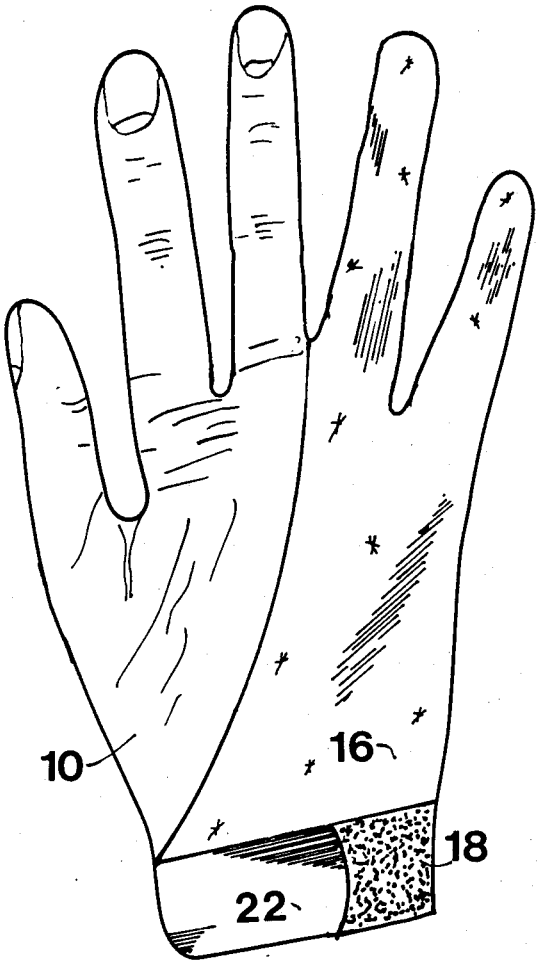
FIG. 1 shows the back side of a golfer's right hand wearing the two fingered glove.
Figure 2:
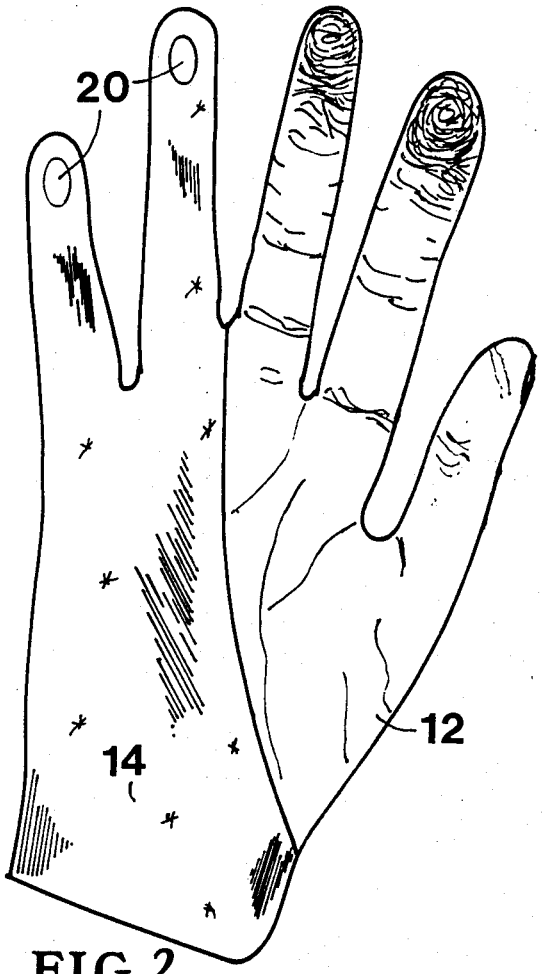
Figure 3:
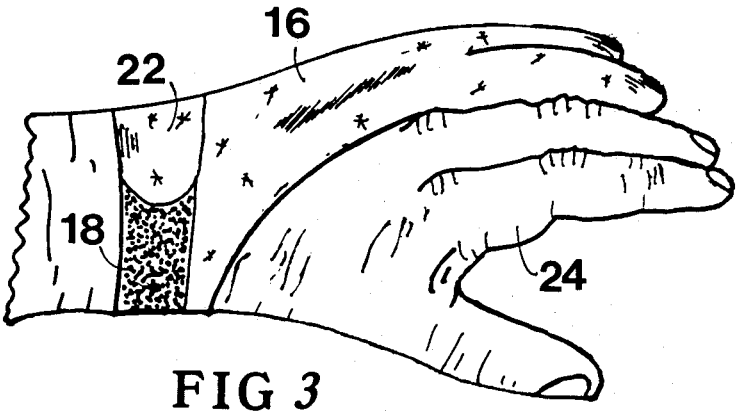

With reference now to FIG. 1 and 11, a preferred embodiment of a right handed golf glove is shown with it being understood that the left handed glove is a mirror image of said right handed glove, and only the right hand will be shown and explained in detail.

10 is the backside of a golfer's right hand while 12 is the palm or front side of said hand and 14 is the two fingered glove showing the palm or front side of the glove which comes in contact with the shaft of a golf club while 16 is the backside of said two fingered glove. 18 is closing means such as the material known by its trademark as VELCRO while 22 is a flap portion which has affixed to it the mating portion of the VELCRO and 24 is a left hand wearing the glove, while 20 are cut outs or apertures in finger tips of the two gloved fingers to expose the sensors in the fingers to the surface of the grip on the golf club shaft.

It will now be readily seen that we have provided a glove which covers only the ring finger and the little finger leaving the index and middle finger and a substantial part of the palm uncovered for better stimulation and the bare handed "feel."

It will also be seen that we have provided a simple glove that is easily removable as required.

It is also to be noted that our new two fingered glove can be made more universal in size as the entire body of the hand is not covered.

Also with the two fingered glove the golfer can "focus" on the grip with better impute from the sensors in the fingers and hands and can therefore improve his mechanical swing.

It is also of importance that we have provided a glove that uses much less material and is therefore more economical to manufacture.

We have also provided openings in the fingers which expose the fingers to the "Pacinian Bodies" buried in the fingers.

It will also be readily seen that we have provided a glove that eliminates the cumbersome aspects of achieving control but still prevents slipping of the club.

It will also be recognized that we have provided a glove with a simple closure by the use of the commercially available material trademarked VELCRO which allows for easier on and off function and variable tightness.

Although the invention has been herein shown and described in what is conceived to be the most practical and preferred embodiments, it is recognized that departures may be made therefrom within the scope of the invention, which is not to be limited to the details disclosed herein but it is to be accorded to the full scope of the claims so as to embrace any and all equivalent devices and apparatus.

Having described our invention, what we claim as new and desire to secure by letters patent is:

1. A left and right golf glove, each of said gloves comprising a main glove portion having a palm, a back side, a gloved ring finger, a gloved little finger, a wrist portion, a removably attaching and detaching means to close the said wrist portion, an uncovered hand portion, said uncovered portion including the thumb, first and middle fingers and substantially including that portion of palm and back side of the hand that is exposed by a boundary line drawn substantially from the V formed by the joining of said middle and said ring fingers to the said thumb side of said wrist portion.

2. A left and right golf glove as defined in claim 1 including apertures in the tips of said gloved ring finger and said gloved little finger to allow sensor contact points in the same fingers to directly contact the grip of the golf club.

3. A left and right golf glove as defined in claim 1 whereby said removable attaching and detaching means is of the loop and pile design.

* * * * *